US009616680B2

(12) United States Patent
Moehringer et al.

(10) Patent No.: US 9,616,680 B2
(45) Date of Patent: Apr. 11, 2017

(54) DEVICE AND METHOD FOR PRINTING ON A SURFACE OF AN OBJECT

(71) Applicant: HEIDELBERGER DRUCKMASCHINEN AG, Heidelberg (DE)

(72) Inventors: Markus Moehringer, Weinheim (DE); Henning Niggemann, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/064,785

(22) Filed: Mar. 9, 2016

(65) Prior Publication Data

US 2016/0263920 A1 Sep. 15, 2016

(30) Foreign Application Priority Data

Mar. 13, 2015 (DE) ..... 10 2015 204 532

(51) Int. Cl.
*B41J 3/407* (2006.01)
*B41J 3/54* (2006.01)

(52) U.S. Cl.
CPC ..... *B41J 3/54* (2013.01); *B41J 3/4073* (2013.01)

(58) Field of Classification Search
CPC ..... B41J 3/4073; B41J 3/54
See application file for complete search history.

(56) References Cited

U.S. PATENT DOCUMENTS

| | | | | |
|---|---|---|---|---|
| 8,201,904 | B2 | 6/2012 | Vesanto et al. | |
| 2002/0097280 | A1 | 7/2002 | Loper et al. | |
| 2009/0073200 | A1* | 3/2009 | Tezuka | B41J 3/4073 347/9 |
| 2010/0091054 | A1* | 4/2010 | Vesanto | B31B 1/00 347/9 |

FOREIGN PATENT DOCUMENTS

| | | | |
|---|---|---|---|
| DE | 102009058212 | A1 | 6/2011 |
| DE | 102010004496 | A1 | 7/2011 |
| DE | 102010003534 | A1 | 10/2011 |
| DE | 102011009395 | A1 | 7/2012 |
| DE | 102013213843 | A1 | 1/2015 |
| JP | H11320863 | A | 11/1999 |
| WO | 2008116973 | A1 | 10/2008 |
| WO | 2011072764 | A1 | 6/2011 |

* cited by examiner

*Primary Examiner* — Manish S Shah
*Assistant Examiner* — Yaovi M Ameh
(74) *Attorney, Agent, or Firm* — Laurence A. Greenberg; Werner H. Stemer; Ralph E. Locher

(57) ABSTRACT

A device for printing on a surface of an object contains a stationary printing unit for printing on the object. The printing unit contains an inkjet print head for creating a print on the surface of the object in an operating area of the print head. A movable holding unit is provided for receiving the object in a receiving region and for a rotary movement of the object from the receiving region into the operating area of the print head and for a linear movement of the object in the operating area of the print head during the creation of the print. At least one control unit is provided for controlling the movements of the holding unit and the creation of the print.

12 Claims, 6 Drawing Sheets

DEVICE AND METHOD FOR PRINTING ON A SURFACE OF AN OBJECT

CROSS-REFERENCE TO RELATED APPLICATION

This application claims the priority, under 35 U.S.C. §119, of German application DE 10 2015 204 532.3, filed Mar. 13, 2015; the prior application is herewith incorporated by reference in its entirety.

BACKGROUND OF THE INVENTION

Field of the Invention

The present invention relates to a device and a method for printing on a surface of an object.

The technical field of the invention is the field of inkjet printing on spatial, three-dimensional objects or bodies, i.e. on the surfaces thereof.

It has become known in the art to print on such objects in designated devices. Golf balls, for instance, may be personalized in an inkjet process in printing devices of special design. Such a device is known, for instance, from published Japanese patent application JP 11320863 A. Golf balls are comparatively small objects that are not very difficult to handle. Larger objects, however, such as soccer balls, are more difficult to handle. For instance, the width of a print head is not sufficient to print on one half of the ball in one pass. In addition, the size and curvature of the ball causes edge nozzles of the print head to be too far away from the surface of the ball, resulting in a loss of accuracy of the print. The ball therefore needs to be moved, in particular rotated, underneath the print head, and the print head needs to be controlled in a suitable way. To be able to move the ball, a holding unit needs to be provided. Similar problems occur when large objects of different shapes, for instance boxes, bags, auto bodies and the like are to be printed. Even collisions may occur and ought to be avoided. In addition, published, non-prosecuted German patent application DE 102009058212 A1 discloses the use of a robot to move the object.

SUMMARY OF THE INVENTION

Based on this background, an object of the invention is to provide an improved device for providing a print on a surface of a 3D object.

In accordance with the invention, a device for printing on a surface of an object contains a stationary printing unit for printing on the object. The printing unit contains an inkjet print head for creating a print on the surface of the object in an operating area of the print head. A movable holding unit is provided for receiving the object in a receiving region and for moving the object in a rotary way from the receiving region into the operating area of the print head and for moving the object in a linear way in the operating area of the print head during the creation of the print. At least one control unit for controlling the movements of the holding unit and the creation of the print is provided.

In accordance with the invention, the device contains a holding unit capable of moving the object in a rotary way as well as in a linear way. The rotary movement moves the object to the print head on a circular path; the translatory movement displaces the object underneath the print head during the printing process. During the translatory movement, the rotary movement is preferably stopped. Advantageously, such a device is of very compact construction; for instance, a plurality of print heads may be provided in a circular arrangement.

A preferred further development of the device of the invention may be characterized in that the printing unit contains a plurality of print heads disposed to be spaced apart from one another on an essentially horizontally oriented circle and in an essentially radial orientation.

A preferred further development of the device of the invention may be characterized in that the device contains a curing unit with an emitter for curing the print in an operating area of the emitter, wherein the curing unit is essentially disposed on a horizontally oriented circle and at a distance from the print heads. The curing unit can alternatively be a dryer.

A preferred further development of the device of the invention may be characterized in that the holding unit contains a plurality of movement units wherein a first movement unit is disposed essentially on a vertical axis, allowing a linear movement of the object in a vertical direction.

A preferred further development of the device of the invention may be characterized in that the holding unit contains a plurality of movement units, wherein a second movement unit is essentially disposed on a vertical axis and essentially perpendicularly underneath the center of the circle, allowing a rotary movement of the object about the vertical axis.

A preferred further development of the device of the invention may be characterized in that the second movement unit is mechanically connected to the first movement unit, preferably disposed thereon.

A preferred further development of the device of the invention may be characterized in that the holding unit contains a plurality of movement units, wherein a third movement unit allows a linear movement of the object in the operating area of the print head. The linear movement serves to advance the object during the printing operation. The linear movement preferably occurs in at least one section of a path that is a tangent or secant to the circular path. The linear movement may occur in a forward and/or in a backward direction underneath the print heads.

A preferred further development of the device of the invention may be characterized in that the third movement unit is mechanically connected to the first and/or second movement unit and is preferably disposed on the second movement unit.

A preferred further development of the device of the invention may be characterized in that the third movement unit contains a linear actuator with a linear axis and that the holding unit contains an arm that is oriented to be essentially perpendicular to the linear axis.

A preferred further development of the device of the invention may be characterized in that the holding unit contains a plurality of movement units wherein every movement unit generates a linear or rotary movement and wherein only one movement unit is active for a rotary movement of the object from the receiving region into the operating area of the print head and from there to the operating area of a further print head or in the operating area of the emitter.

A preferred further development of the device of the invention may be characterized in that the holding unit contains a suction gripper.

A preferred further development of the device of the invention may be characterized in that every print head contains a respective closure that protects the print head nozzles against the radiation of the emitter when in a closed condition.

A preferred further development of the device of the invention may be characterized in that every print head is received in a respective alignment unit, which allows the print head to be linearly aligned in radial and tangential directions and axially aligned about a print head axis that is perpendicular to the plane of the circle.

A preferred further development of the device of the invention may be characterized by a projection unit for projecting a mark onto the object in the receiving region.

A preferred further development of the device of the invention may be characterized by a measuring unit for measuring at least one section of the surface of the object in a touch-free way, making the measured data obtained in this way available in particular for a correction of the distance between the object and the print head or emitter.

A preferred further development of the device of the invention may be characterized by a pre-curing unit containing an emitter and pre-curing the print.

A preferred further development of the device of the invention may be characterized by a delivery region and by the facts that the holding unit moves the object from the operating area of the curing unit to the delivery region and the at least one control unit controls this movement.

A method of the invention for printing on an object using an inkjet print head is a method wherein prior to the printing operation, the object is moved along at least one section of a circular path into an operating area of the print head in a rotary movement and wherein during the printing process, the object is linearly moved on at least one section of a path that is a tangent or secant to the circular path. In accordance with the invention, the object is moved in a rotary movement before and after the printing process and in a translatory movement during the printing process. Advantageously, the method may be carried out quickly and with a high degree of accuracy.

Other features which are considered as characteristic for the invention are set forth in the appended claims.

Although the invention is illustrated and described herein as embodied in a device and a method for printing on a surface of an object, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
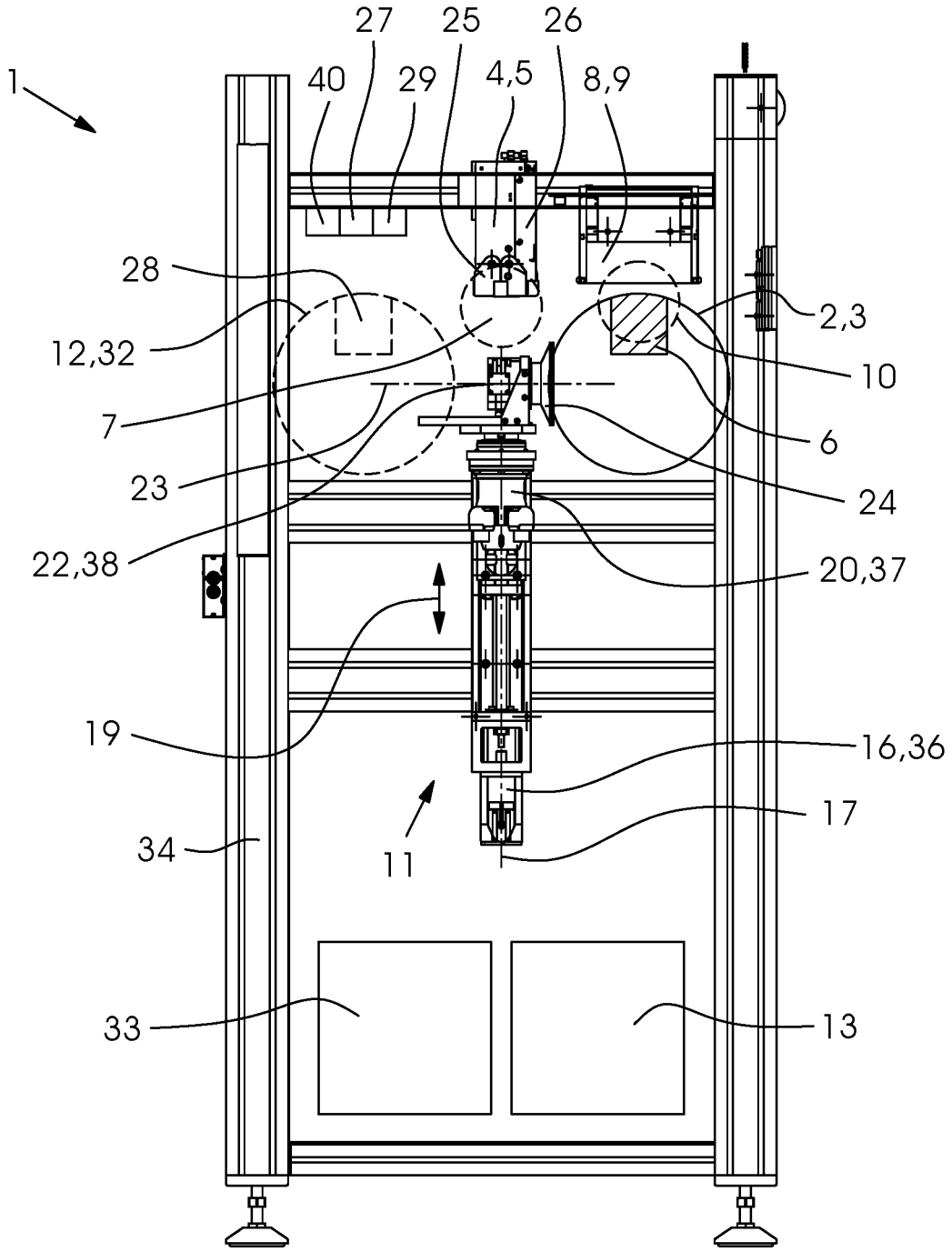
FIG. 1 is a diagrammatic, side view of a device according to the invention.
Figure 2:
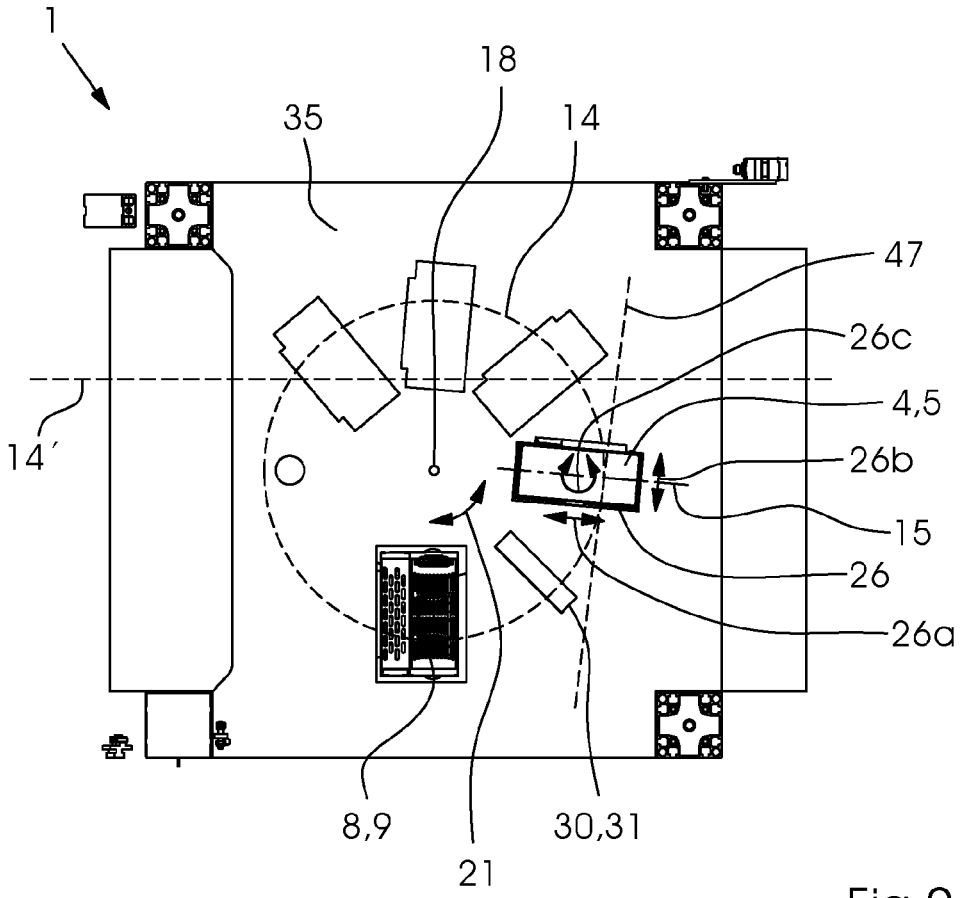
FIG. 2 is a top view of the device.
Figure 4:
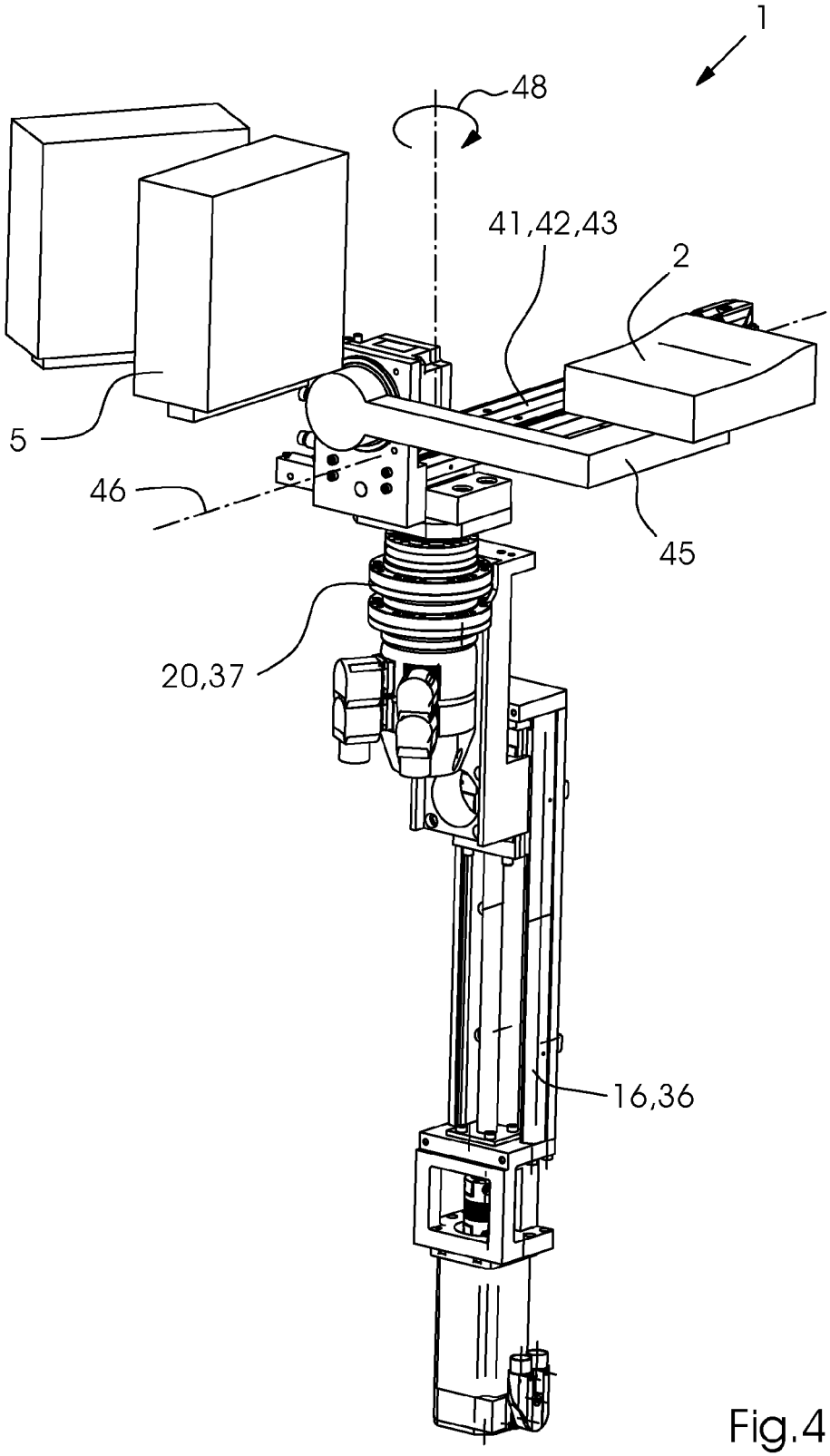
FIGS. 4 and 5 are perspective views of a preferred embodiment of the device of the invention.
Figure 5:
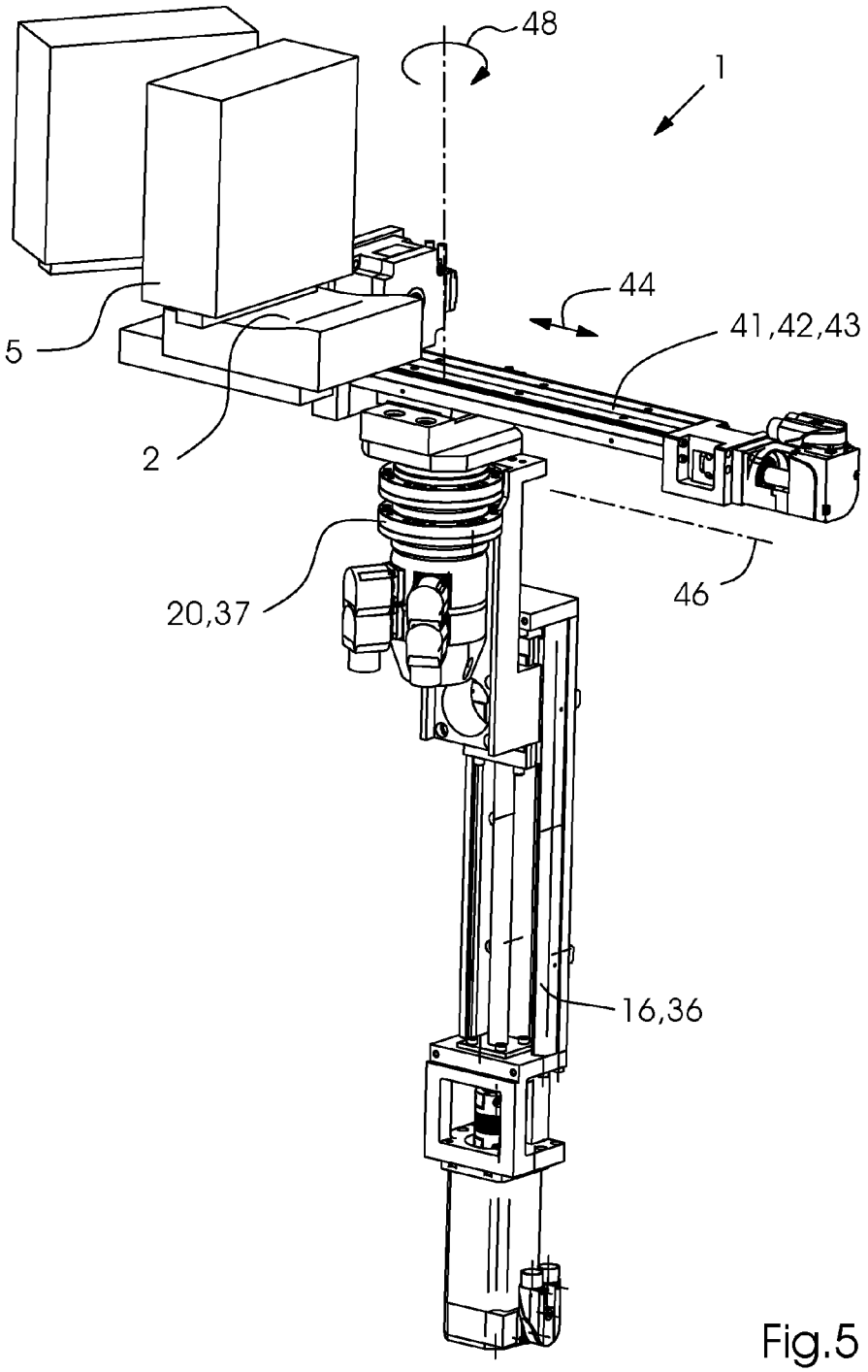

Referring now to the figures of the drawings in detail and first, particularly to FIG. 1 thereof, there is shown a side view of a device 1 for printing on a surface 3 of a three-dimensional moving object 2. The surface 3 may be curved in any direction. The object may preferably have a flat, relief-like, or merely a slightly bent surface as shown in FIG. 4 and FIG. 5 (reference numeral 2). The object may alternatively be a ball, for instance. FIG. 2 is an elevational view of the device 1. In the two figures, corresponding elements have the same reference symbol.

The device 1 contains a printing unit 4. The printing unit 4 is stationary and disposed in an upper region of the device. The printing unit contains an inkjet print head 5. The print head 5 is received in an alignment unit 26 of the printing unit. The alignment unit 26 is disposed in an opening in a horizontally oriented plate 35 of a frame 34 of the device 1. The plate has a plurality of openings potentially to receive a plurality of print heads. The openings and the plurality of print heads are located on a circle 14 about a center 18. The openings may be provided in different positions, orientations and sizes to accommodate print heads of different sizes and objects to be printed of different sizes. Every print head prints one color in the form of ink drops emitted by nozzles arranged in nozzle rows 15. If a multicolor print 6 is to be created on the object 2, multiple print heads are provided, for instance in accordance with a known CMYK printing process. However, there may be even more print heads, for instance up to 7 print heads, if spot colors, opaque white, or a varnish are to be used. A non-illustrated ink supply system connects the print heads to one or more ink reservoirs 33 disposed in a lower region of the device 1. The ink reservoir may be located outside the device.

Respective alignment units 26 or print-head receiving elements are provided to adjust the print heads 5 in three directions: linearly in radial and tangential directions 26*a*, 26*b* relative to the circle 14 and axially about a print head axis 26*c* that is perpendicular to the plane of the circle. In most cases, such an alignment will only be necessary when the device is installed or in the case of maintenance work. During a printing process, the print heads remain fixed in position. Another option is to incline the print heads in a direction towards the central axis of the device 1. This may be advantageous in the case of elongated objects 2 to prevent them from colliding with the inactive print heads during the printing process.

The print heads 5 may be configured as two-color heads that nevertheless print only one color. The nozzles for the second color are then used as back-up nozzles that may be used to print the first color in the case of a nozzle failure.

The same plate 35 has a further opening containing a curing unit 8 with an emitter 9. The emitter is preferably a UV lamp if UV ink is used; alternatively, it may be an IR lamp. The emitter may be an LED. The emitter is likewise disposed on the circle 14. The print heads 5 are disposed on the circle so as to succeed one another in one direction. The emitter is disposed behind these print heads in terms of this direction. The curing unit/the emitter has an operating area 10. In addition to the curing unit, a pre-curing unit 30 (known as a pinning module) including an emitter 31 may be provided. Even a plurality of pinning modules may be provided, namely a respective one after every print head 4.

To protect the print heads 5 against the radiation of the curing unit 8, respective closures 25 (known as shutters) are provided on the print heads. Inactive heads are closed when the curing unit is active to prevent ink from curing on or even in the nozzles. Every shutter may have two pivoting flaps.

Underneath the plate 35, i.e. in the central region of the device 1, a modular holding unit 11 is disposed on the frame 34. The holding unit has a vertical axis 17 extending essentially through the center 18 of the circle 14. The holding unit is provided to receive and transport/rotate the object 2, i.e. it holds the object during the printing process in which the object is moved. The object is received in a receiving region 12, for instance it is transferred to a suction gripper 24 by hand or in an automated way. The suction gripper may include a metal suction cup with three or more suction openings (see suction gripper 24 in FIG. 3).

In the receiving region, a projection unit 27 may optionally project an optical mark 28 onto the surface 3 of the object 2, for instance by a laser or an LCD projector. The mark is a positioning aid to make it easier for the operator to insert the object in a desired orientation. Alternatively, a positioning cross may be projected onto the object by laser light. It is also possible to project two crosses to different locations onto the object (preferably in approximately opposite locations).

A measuring unit 29 likewise provided in the receiving region may optionally measure at least one section of the surface 3 of the object 2 in a touch-free way. The measuring unit may comprise a camera or a distance sensor. Its purpose is to detect the shape of the object. Deviations from the target shape and/or from the target size may be calculated from the measured data, for instance distance data, and may be saved. At a later point, these data may be used in the creation of the print and the curing process to correct the distance of the units from the surface by a correction of the distance of the object. The measured data may be used to automatically move the image to be printed within the printable region.

Optionally, a provision may be made for the surface area to be printed on of the object 2 to be pre-treated with a primer to improve the adherence of the ink. For this purpose, a primer unit 40 may be provided in the receiving region 12, for instance. The primer unit may for instance include a transfer belt for applying the primer. The belt may also be used to remove a (test) print that has already been created but not yet cured. The belt may also be used to clean the object prior to the application of the primer, in particular to remove dust.

The holding unit 11 preferably contains at least three modular movement units. A first movement unit 16 is disposed on the vertical axis 17. The first movement unit contains a first (linear) drive 36, which allows the object 2 to carry out a linear movement 19 in a vertical direction. This movement is primarily made to align the object in terms of its height, in particular in terms of the distance from the print heads 4 and the emitter 9 during the printing or curing operation.

The holding unit 11 contains a second movement unit 20, which is disposed on the first movement unit 16 and provides a rotary movement 21 of the object 2 about the vertical axis 17 so that during its transporting movement, the object successively reaches the operating area 7 of the print head 2 and the operating area 10 of the emitter. For this purpose, the second movement unit contains a second (rotary) drive 37. This drive primarily drives the transporting movement of the object from unit to unit, for instance from print head to print head.

The holding unit 11 receives the object and conveys it in a timed way from the receiving region 12 into the operating area 7 of the print head 4 or successively into the operating areas 7 of the plurality of print heads 4. After the printing process, the holding unit conveys the object into the operating area of the curing unit 8 in a timed way. From the curing unit 8, the holding unit 11 conveys the object into the delivery region 32 in a timed way, where the object is manually or automatically removed. The delivery region is preferably identical with the receiving region and is located behind a lateral opening that is formed in the frame and may be closed by a door. However, delivery region and receiving region may be different regions.

If a pinning module 30 is provided, the holding unit 11 may convey the object from one print head to the pinning module and subsequently to the next print head and from the last print head to the curing unit 8. Such a movement may include forward movements and backward movements (in the direction of the circle).

The movement of the object 2 is controlled by a control unit 13 disposed in the lower region of the device 1. The control unit 13 controls at least the holding unit 11 and the drives 36 and 37 thereof. The same control unit may also actuate the print heads 2 and the emitter 9, at least the on and off times thereof. The printing data for the print heads are fed to the print heads either directly from a non-illustrated unit of what is referred to as the pre-press department or via the control unit 13.

If identical objects are printed on, the holding unit 11 may advantageously always carry out identical (pre-set or saved) movements, both in terms of the transport of the ball and in terms of the rotation during the printing process. The following general provisions apply (without limitation to the illustrated embodiment): the holding unit 11 has a number of movement units, every one of which generates a linear movement or a rotary movement, and only one movement unit is active for a rotary movement of the object 2 from the receiving region 12 to the operating area 7 of the print head 5 and from there to the operating area 7 of a further print head or in the operating area 10 of the emitter 9. In this way, positioning errors of the object during the printing or curing process may advantageously be minimized. If significant positioning errors occur nevertheless, they are reproducible and may thus be compensated for in the printing process by suitably compensatory printing data.

Figure 3:
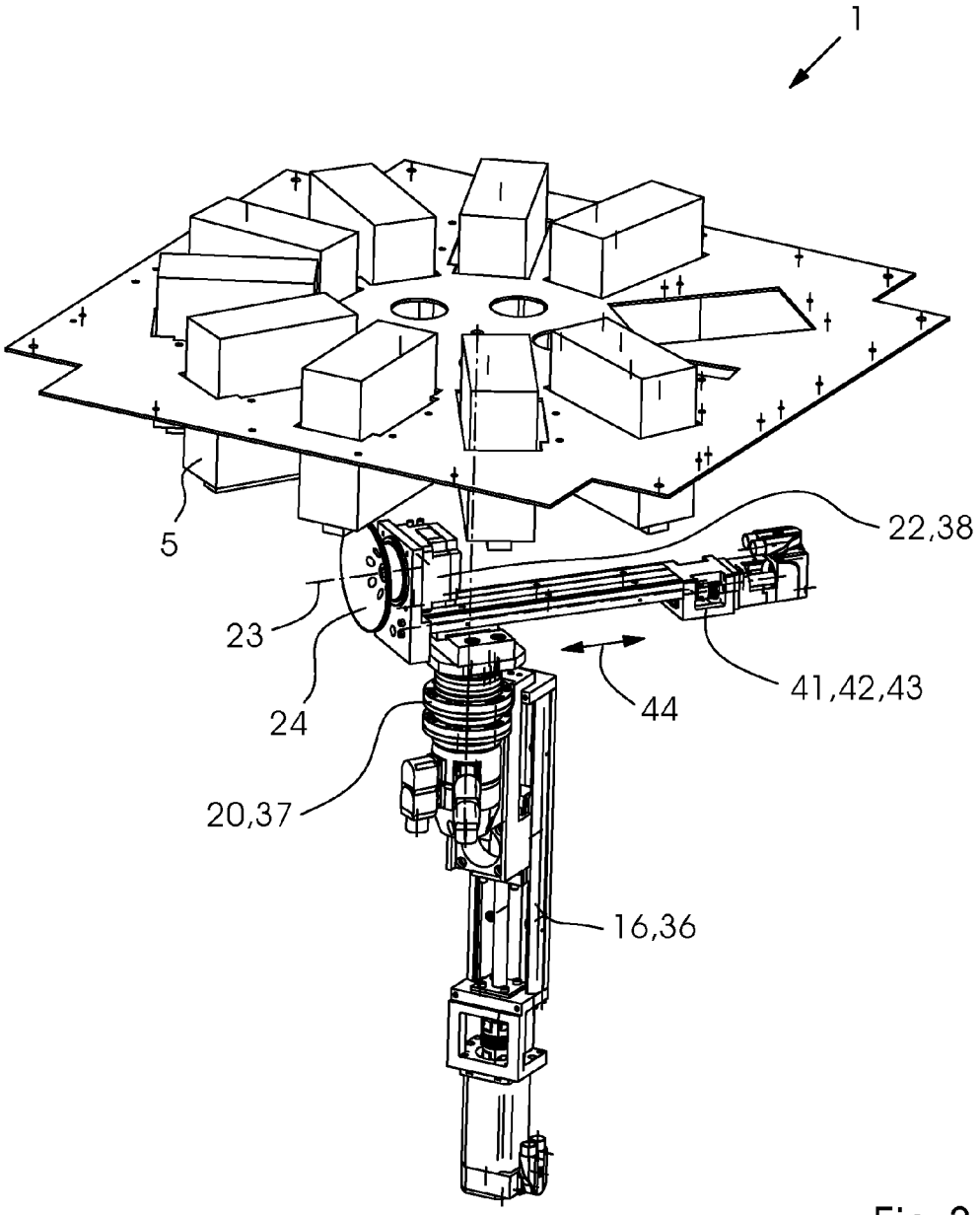
FIG. 3 is a perspective view of a preferred embodiment of the device.

FIG. 3 is a perspective view of a further device 1. The device 1 contains a first movement unit 16 with a first linear drive 36 and a second movement unit 20 with a rotary drive 37. In addition, the device contains a third movement unit 41 with a linear drive 42 (servomotor). The third movement unit is disposed on the second movement unit. A carriage 43 allows the object to carry out a movement 44 in a radial direction (in parallel with the radial axis 23). The third movement unit 41 is used for an adaptation/adjustment to print on objects 2 of different sizes.

A printing process using the device 1 shown in FIG. 3 takes place as now described.

Movement unit 16 is used for a compensatory movement if the object 2 deviates from its ideal shape or is mounted inaccurately. In this way, a constant distance between the object and the print head 5 may be maintained. For this purpose, the actual shape and mounting of the object are measured and transmitted to the control unit 13.

Movement unit 20 is used to move the object 2 from unit to unit (priming, printing, curing) in a timed way.

As described above, movement unit 41 is used for size adaptation purposes. For cylinders, movement unit 41 is used for advancement in a radial direction, allowing one print head 5 to apply multiple adjacent printing strips to the objects.

FIG. 4 is a perspective view of a preferred embodiment of a device 1 of the invention. The device 1 has all the features described with reference to FIGS. 1 to 3. A distinguishing feature of the device 1 of FIG. 4 is, however, the way in which the object 2 is held. An arm 45 is disposed on the carriage 43 of the third movement unit 41 (or on the drive 38). The orientation of the arm is perpendicular to the linear axis 46 of the linear actor 42. The arm allows the object to be held at a lateral distance from the linear axis instead of on the linear axis.

To print on the object 2, the object is transported into the operating area 7 of the print head 5 by the rotary drive 37. The print head 5 has a radial orientation, i.e. its nozzle plate extends in an essentially radial direction relative to the circle 14. The linear axis 46 of the third movement unit 41 is oriented to be perpendicular to this radial direction. This advantageously allows the object 2 to be moved linearly underneath the nozzles of the nozzle plate of the print head 5. This linear movement occurs on a section of a path that is a tangent (see tangent 47 in FIG. 2) or, alternatively, a secant (any desired secant that passes through the operating area of the print head) to the circular path of the rotary movement 48 or to the circle 14 in FIG. 2.

A comparison between FIGS. 3 and 4 indicates that the device may be used multi-functionally: in FIG. 3, a suction gripper 24 is disposed on the carriage 43. The suction gripper may receive a rotation-symmetric object 2, such as a ball, and may rotate it during the printing process. Instead of the suction gripper, the arm 45 may be disposed on the carriage, and then the movement that occurs during the printing process may then be a linear movement instead of a rotary movement. After certain changeover operations, the device 1 may therefore be used to print on different objects. To print on rotation-symmetric objects, the linear axis 46 is oriented to be essentially parallel to the print head alignment (direction of the nozzle plate/nozzle row). To print on flat, relief-like objects or objects with only a slight curvature, the linear axis is oriented to be essentially perpendicular to the alignment of the print head. The necessary changes may be made by hand or in an automated way. Like the suction gripper 24, the arm 45 may have one or more suction ducts to hold the object 2 by suction on the arm or on an object carrier on the arm.

If the rotary drive 38 is not required, for instance because only flat, relief-like objects or objects with only a slight curvature are to be printed on, the device 1 may not even have such a drive.

Figure 6:
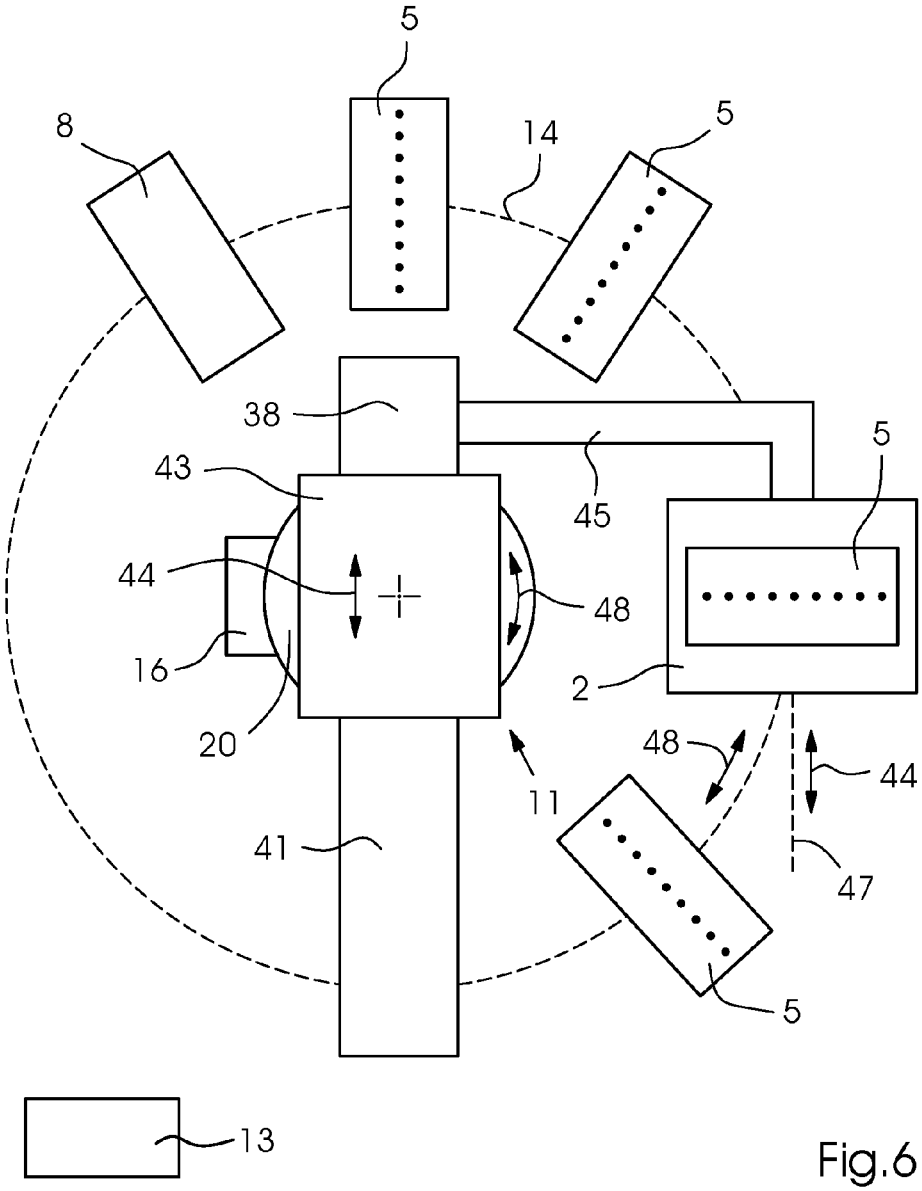
FIG. 6 is a diagrammatic top view of the preferred embodiment of the device of the invention.

FIG. 6 is a diagrammatic elevational view of the embodiment of the device 1 of the invention shown in FIGS. 4 and 5. Four print heads 5 and the curing unit 8 are shown to be disposed in a circle 14. The first movement unit 16, the second movement unit 20, and the third movement unit 41 are disposed in the center of the circle. The carriage 43, which is movable in a direction 44, is disposed on the third movement unit 41. The arm 45 is disposed on the carriage, for instance via the drive 38. The arm carries the object 2, which is positioned underneath the print head 5. The rotary movement 48 moves the object from unit to unit in a timed way. In the operating area of every printing unit 5, the rotary movement 48 stops and the linear movement 44 starts. During the linear movement, the print is applied to the object. The linear movement occurs on a tangent 47, alternatively on a secant, passing through the operating area of the print head.

The following is a summary list of reference numerals and the corresponding structure used in the above description of the invention:

1 device
2 object, in particular ball
3 surface
4 printing unit
5 (inkjet) print head
6 print
7 operating area
8 curing unit
9 (UV) lamp
10 operating area
11 holding unit
12 receiving region
13 control unit
14 circle
14' straight line
15 nozzles, row of nozzles
16 movement unit
17 vertical axis
18 center of circle
19 movement
20 movement unit
21 movement
22 movement unit
23 radial axis
24 suction gripper
25 closure
26 alignment unit
**26*a*** movement
**26*b*** movement
**26*c*** movement, axis
27 projection unit
28 mark
29 measuring unit
30 pre-curing unit
31 emitter
32 delivery region
33 ink supply
34 frame
35 plate
36 drive
37 drive
38 drive
40 primer unit
41 third movement unit
42 drive, linear actuator
43 carriage
44 movement
45 arm
46 linear axis
47 tangential path
48 rotary movement

The invention claimed is:

1. A device for printing on a surface of an object, the device comprising:

a stationary printing unit for printing on the object, said stationary printing unit having an inkjet print head for creating a print on a surface of the object in an operating area of said inkjet print head;

a movable holding unit for receiving the object in a receiving region;

at least one control unit configured for controlling a rotary movement of the object from the receiving region to an operating area of said inkjet print head and said at least one control unit configured for performing a linear movement of the object in the operating area of said inkjet print head during a creation of the print, the linear movement being on at least one section of a path that is a tangent or a secant to an arcuate path of the rotary movement; and said at least one control unit configured for controlling a movement of said movable holding unit and the creation of the print.

2. The device according to claim 1, wherein said inkjet print head is one of a plurality of print heads and said print heads are disposed to be spaced apart from one another generally on a circle of horizontal orientation and in an generally radial orientation.

3. The device according to claim 2, further comprising a curing unit with an emitter for curing the print in an operating area of said emitter, said curing unit disposed on a circle of horizontal orientation to be spaced apart from said print heads.

4. The device according to claim 2, wherein said movable holding unit contains a plurality of movement units, said movement units include a first movement unit disposed on a vertical axis and allows a linear movement of the object in a vertical direction.

5. The device according to claim 4, wherein said movement units include a second movement unit disposed on the vertical axis and perpendicularly below a center of a circle and allows a rotary movement of the object about the vertical axis.

6. The device according to claim 5, wherein said second movement unit is mechanically connected to said first movement unit.

7. The device according to claim 5, wherein said plurality of movement units include a third movement unit which allows a linear movement of the object in the operating area of said inkjet print head.

8. The device according to claim 7, wherein said third movement unit is mechanically connected to at least one of said first movement unit or said second movement unit.

9. The device according to claim 7, wherein:

said third movement unit contains a linear actuator with a linear axis; and said movable holding unit contains an arm oriented to be perpendicular to the linear axis.

10. The device according to claim 5, wherein said second movement unit is mechanically connected to said first movement unit and is disposed on said first movement unit.

11. The device according to claim 7, wherein said third movement unit is disposed on said second movement unit.

12. A method for printing on an object using an ink jet print head, which comprises the steps of:

moving the object along at least a section of an arcuate path into an operating area of the ink jet print head in a rotary movement prior to a printing process; and during the printing process, moving the object linearly on at least one section of a path that is a tangent or a secant to the arcuate path.

* * * * *